US008359847B2

(12) United States Patent
Hatchett

(10) Patent No.: US 8,359,847 B2
(45) Date of Patent: Jan. 29, 2013

(54) DEVICE AND METHOD FOR CONVERTING A MOTORCYCLE EXHAUST SYSTEM INTO A MULTIPLE EXHAUST SYSTEM

(76) Inventor: Albert Earl Hatchett, Jenkinsburg, GA (US)

( * ) Notice: Subject to any disclaimer, the term of this patent is extended or adjusted under 35 U.S.C. 154(b) by 505 days.

(21) Appl. No.: 12/587,035

(22) Filed: Oct. 1, 2009

(65) Prior Publication Data

US 2011/0079005 A1 Apr. 7, 2011

(51) Int. Cl.
*F01N 1/00* (2006.01)

(52) U.S. Cl. ..... 60/324; 60/274; 60/312; 60/322

(58) Field of Classification Search ..... 60/312–314
See application file for complete search history.

(56) References Cited

U.S. PATENT DOCUMENTS

| | | | | |
|---|---|---|---|---|
| 3,805,521 | A * | 4/1974 | Dafler et al. | 60/288 |
| 4,800,719 | A * | 1/1989 | Campbell | 60/313 |
| 4,860,538 | A * | 8/1989 | Takeuchi | 60/313 |
| 4,869,063 | A * | 9/1989 | Sakurai et al. | 60/313 |
| 5,044,928 | A * | 9/1991 | Yokoyama et al. | 431/1 |
| 5,743,088 | A * | 4/1998 | Grath | 60/324 |
| 6,026,930 | A * | 2/2000 | Ogisu et al. | 181/228 |
| 6,286,307 | B1 * | 9/2001 | Feeny et al. | 60/324 |
| D454,320 | S | 3/2002 | Martin | |
| D467,847 | S | 12/2002 | Campbell | |
| D483,710 | S | 12/2003 | James | |
| 6,675,933 | B2 * | 1/2004 | Yamaguchi | 181/227 |
| D520,925 | S | 5/2006 | Savage | |
| 7,347,045 | B2 * | 3/2008 | Bozmoski et al. | 60/312 |
| 7,350,351 | B2 | 4/2008 | Ueshima | |
| 7,364,010 | B2 * | 4/2008 | Konno | 181/228 |
| 7,596,944 | B2 * | 10/2009 | Mueller et al. | 60/323 |
| 2002/0083703 | A1 | 7/2002 | Werth | |

FOREIGN PATENT DOCUMENTS

| | | |
|---|---|---|
| JP | 2008069704 | 3/2008 |

* cited by examiner

*Primary Examiner* — Thomas Denion
*Assistant Examiner* — Diem Tran
(74) *Attorney, Agent, or Firm* — J. T. Hollin, Attorney at Law, P.C.

(57) ABSTRACT

Disclosed is an exhaust extension apparatus and method for converting a motorcycle exhaust system into a dual or quadruple exhaust system. The device is suited for motorcycles, off-road vehicles, or a vehicle with a reciprocating engine with multiple cylinders. Each exhaust extension unit comprises two metallic pipes shaped and welded together to form an exhaust extension unit having one exhaust intake and two equal-flow exhaust exits. Two exhaust extension units may be paired and connected to the exhaust pipes on each side of a motorcycle rider's seat, thereby providing a quadruple set of exhaust pipes and further, an increase in the performance of the engine.

7 Claims, 3 Drawing Sheets

DEVICE AND METHOD FOR CONVERTING A MOTORCYCLE EXHAUST SYSTEM INTO A MULTIPLE EXHAUST SYSTEM

CROSS-REFERENCES TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

REFERENCE TO A "SEQUENCE LISTING," A TABLE, OR A COMPUTER PROGRAM LISTING APPENDIX

Not applicable.

BACKGROUND OF THE INVENTION (1) Field of the Invention

Motorcycles have a wide of variety of exhaust systems, including headers, exhaust pipes, and mufflers. Multi-cylinder motorcycles typically have exhaust ports on both sides of the motorcycle, wherein the exhaust gas is directed through ports leading to headers. The headers are normally routed to one side of the motorcycle into a single exhaust pipe, or dual exhaust pipes on the larger motorcycles.

An exhaust system contributes to an increase in the efficiency of a reciprocating engine by means of the length of the exhaust pipe(s) connected to the engine. A good resolution of the task of increasing efficiency is to provide for an expansion volume in the exhaust gas line into which the exhaust pipes lead, if the said volume can be made large enough. Exhaust system arrangements have been designed in a variety of ways, quite often, based on increasing the cross-sectional surface area of the exhaust pipes so as to equal or exceed the cross-sectional area of the exhaust ports.

(2) Description of the Related Art, including information disclosed under 37 CFR 1.97 and 1.98.

In U.S. Pat. No. 4,800,719 (Campbell 1989) the inventor has designed an exhaust system for a multiple cylinder motorcycle engine which provides that pipes leading from the exhaust ports of the engine flow into a collection chamber. The collection chamber further has two discharge pipes which terminate with a silencing device at the end of each.

U.S. design Pat. No. D454,320 (Martin, 2002) depicts two curvilinear headers which symmetrically collect exhaust gasses leading from the exhaust ports of a motorcycle engine, further extending and routed to form a closely joined curvilinear pair of exhaust pipes on one side of the motorcycle.

U.S. patent application publication US2002/0083703 (Werth, 2002) presents a manifold arrangement for multi-cylinder motorcycle engines. Essentially the system collects exhaust gasses from all cylinders and funnels into two equal-flow exhaust pipes and ultimately into a joint pipe. The joint pipe subsequently divides into two branches which recombine into a single collector pipe in which a wave impedance device is installed.

U.S. Pat. No. D467,847 (Campbell, 2002) illustrates the design for a motorcycle exhaust system comprising a single exhaust header collecting exhaust gasses leading from all the exhaust ports of the motorcycle, with the single exhaust header subsequently diverging into two flared exhaust pipes and/or mufflers.

U.S. Pat. No. D483,710 (James 2003) shows a design for a motorcycle exhaust system comprising two exhaust headers which collect exhaust gasses leading from the exhaust ports of the motorcycle, and subsequently are bent and converged into two adjacent curvilinear exhaust pipes.

U.S. Pat. No. 7,350,351 (Ueshima, A, 2008) is an exhaust system for a motorcycle wherein the system is designed to provide that the exhaust pipes are arranged suitably so that components are positioned as close as possible to the center of gravity of the motorcycle. Generally, exhaust from the right side exhaust ports of the motorcycle are routed into exhaust pipes on the right side, and similarly for the left side of the motorcycle.

BRIEF SUMMARY OF THE INVENTION

The inventive concept presented herein displays a unique exhaust extension device suitable for motorcycles. The device comprises two separate pipes composed of a suitable metal which are machined and then welded together to form one exhaust extension unit. The unit is then attached to the rear portion of the existing header or straight exhaust pipe of a motorcycle engine. In the preferred embodiment, the exhaust extension units are utilized on a motorcycle equipped with dual exhaust pipes, one on each side of the motorcycle. An exhaust extension unit is attached to each of the existing pipes, just prior to the muffler, if the motorcycle is so equipped. The parallel arrangement of the exhaust extension units provides the function and look of quadruple pipes (or quads) extending from the rear of the motorcycle.

Index to Nomenclature of Invention Components

| | |
|---|---|
| 1. | Exhaust extension unit |
| 2. | First pipe |
| 3. | Expanded diameter |
| 4. | Header end |
| 5. | First tail end |
| 6. | Exhaust from header |
| 7. | First centerline |
| 8. | Circular incision |
| 9. | Junction opening |
| 10. | Bend line |
| 11. | Deflector tab |
| 12. | First pipe entry flow |
| 13. | Second pipe entry flow |
| 14. | Second pipe |
| 15. | Second centerline |
| 16. | Elbow |
| 17. | Outer elbow |
| 18. | Inner elbow |
| 19. | Upper elliptical lip |
| 20. | Lower elliptical lip |
| 21. | Continuous welded seam |
| 22. | Exhaust 1 exit flow |
| 23. | Junction end |
| 24. | Exhaust 2 exit flow |
| 25. | Second tail end |
| 26. | Exhaust header |
| 27. | Straight exhaust pipe |
| 28. | Clamp |

-continued

| Index to Nomenclature of Invention Components | |
|---|---|
| 29. | a), b) Left muffler |
| 30. | a), b) Right muffler |
| 31. | Motorcycle |
| 32. | Pipe flare-out |

DETAILED DESCRIPTION OF THE INVENTION

Figure 1:
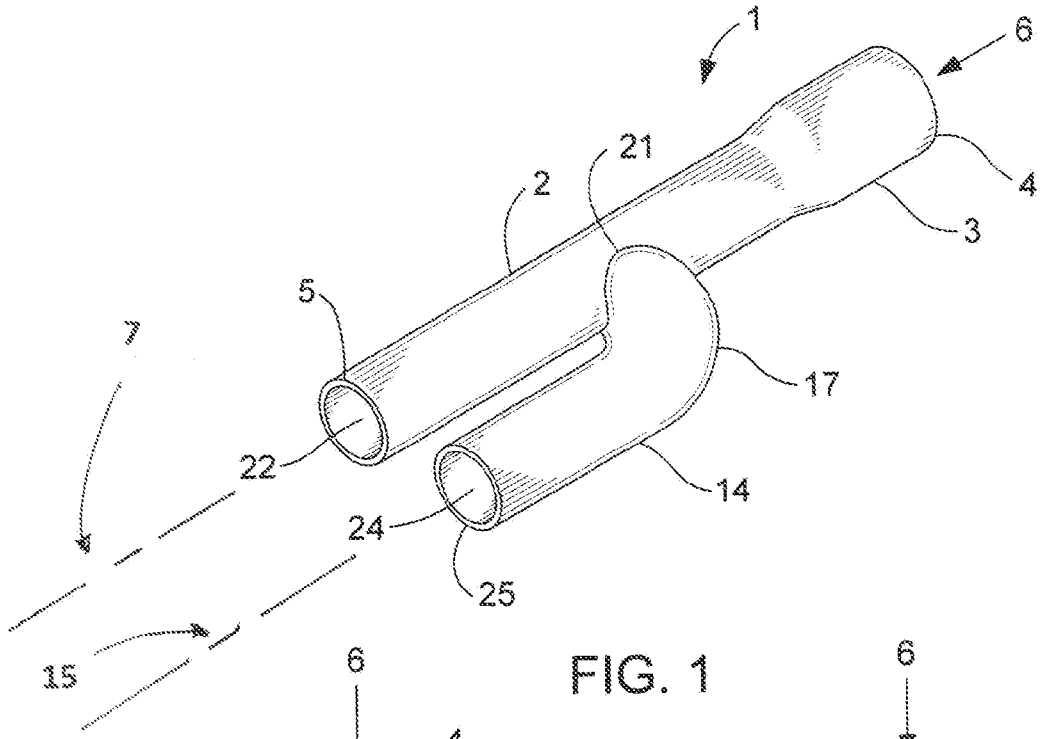
FIG. 1 illustrates the assembled unit comprising the exhaust extension, which is the subject of this inventive concept.

In referring to FIG. 1, a completely finished exhaust extension unit 1 is depicted. The illustration gives a general idea of how the first pipe 2 and the second pipe 14 are joined together at a continuous welded seam 21. The exhaust extension unit 1 is attached, at the header end 4 of the first pipe 2, to either an exhaust pipe or a header, enabling the capture of exhaust 6 from the motorcycle's engine.

Figure 2:
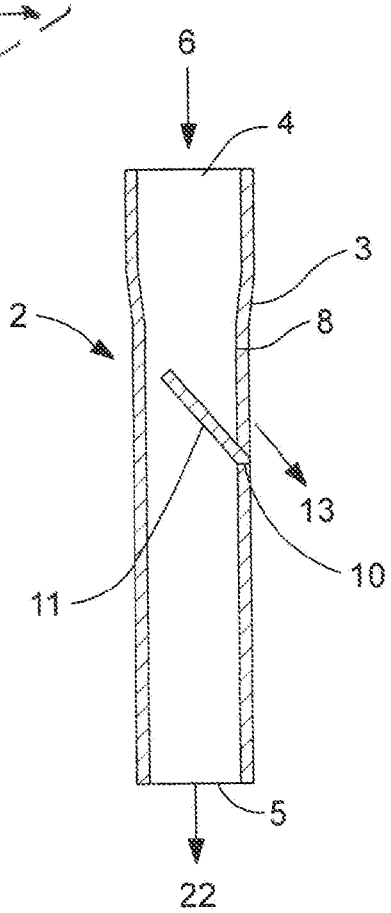
FIG. 2 is a cutaway top view of the first pipe, showing the deflector tab.

In FIG. 2, a cutaway view of the first pipe 2, as seen from overhead the motorcycle, is displayed. As exhaust gas 6 from the motorcycle engine enters the first pipe 2, the exhaust is diverted by a deflector tab 11, whereby one-half the exhaust flows through the first pipe 2 and exits at the Exhaust 1 exit 22. The other half of the arriving exhaust flows through the circular incision 8 cut into the first pipe 2 and into the exhaust 2 entry 13 of the second pipe.

Figure 6:
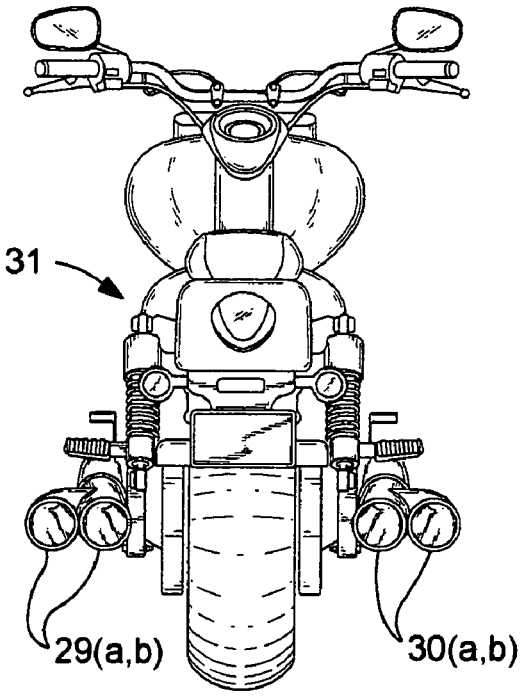
FIG. 6 presents a rear view of a motorcycle outfitted with paired exhaust extension units, terminating in a quadruple exhaust system.
Figure 6A:
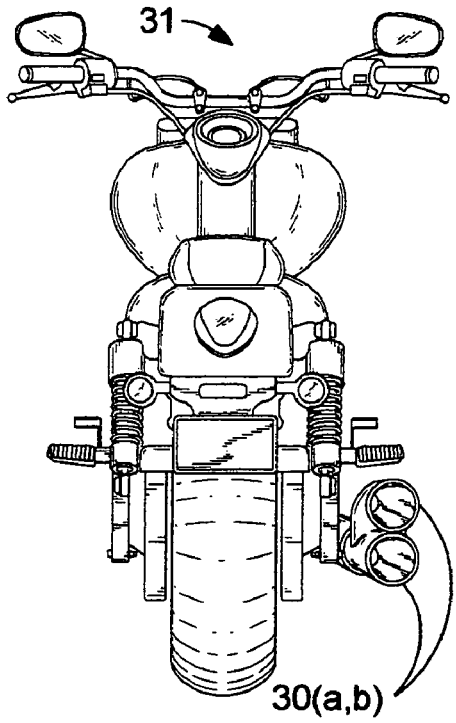
FIG. 6A shows the rear view of a motorcycle where a single exhaust extension unit has been installed with the first and second pipes in a vertical orientation.

The fabrication of the exhaust extension unit 1 begins with a straight length of first pipe 2, which length may be in the range of eighteen inches to three feet. The first pipe 2 may be purchased from normal supply sources with a pre-existing 3-inch long expanded diameter 3 at one end of the pipe. The expanded diameter 3 has an inside diameter of sufficient dimension to snugly fit over the exterior diameter of a motorcycle exhaust header 26 or straight pipe 27 leading from the motorcycle engine, as shown in FIG. 6. This inside dimension of the expanded diameter 3 is nominally 1&¾ inches, and further, this end of the first pipe 2 is designated the header end 4. The first pipe 2 is then cut at its opposite end, designated as the first tail end 5. The total length of the first pipe 2 is dependent on the wheelbase of the motorcycle and possibly, the size of the muffler 29, 30, if any, to be utilized on the motorcycle.

Figure 3:
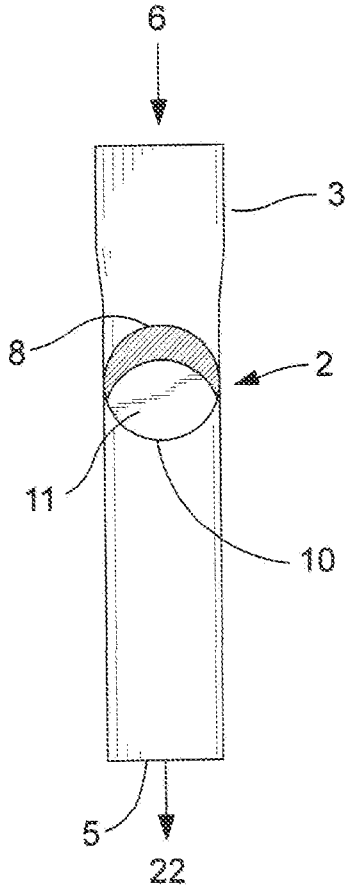
FIG. 3 is a side view of the first pipe, showing the circular incision and a portion of the deflector tab.

The next step of fabrication is made clear in reference to FIG. 3, a side view of the first pipe 2. At a short distance from the start of the flare-out 32 leading to the expanded diameter 3, a partial circular incision 8 encompassing approximately a 300 degree arc, is cut into the first pipe 2. The remaining uncut 60 degrees of the projected circular incision establishes an attached segment of metal, which segment will be utilized as a deflector tab 11. The segment of metal is thereupon subjected to moderate force along a "bend line" 10, toward the interior of the first pipe 2 at an angle of forty-five degrees to the first pipe centerline 7. FIG. 3 displays the circular incision 8 and the deflector tab 11. The expanded diameter 3 at the header end 4 of the first pipe 2 serves to facilitate the first pipe 2 accommodating the outer diameter of a header 26 or a straight exhaust pipe 27 extending from the engine of the motorcycle 31.

Next in the fabrication process is the use of a second pipe 14, the length of which will be somewhat shorter than the first pipe 2 and having the same inner and outer diameter as the first pipe 2. A machining process is availed to form an elliptically-shaped arc at one end of the second pipe 14. Thus, an outer elbow 17 and inner elbow 18 are formed, proximate this junction end 23 of the second pipe 14. The elbow 16 must be of such contour as to render the centerlines 7, 15 of both pipes parallel when the weld 21 is completed and the exhaust extension unit 1 is finally attached to the exhaust pipe 27 of the motorcycle 31.

Figure 4A:
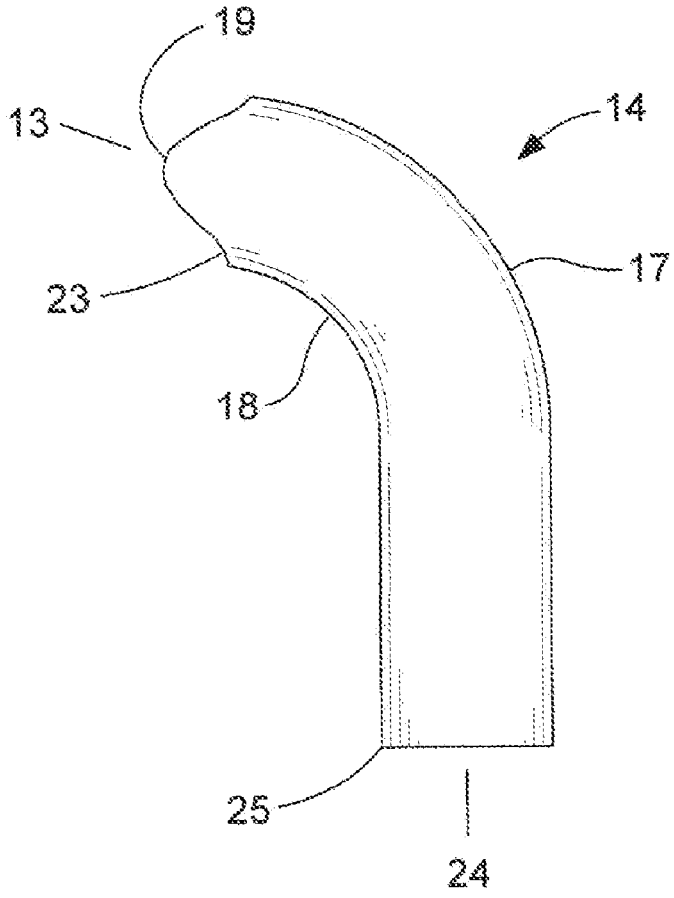
FIG. 4A presents a top view of the second pipe.

As we view FIG. 4A, a top view of the second pipe 14 is shown. This view gives an indication of the general shape of the second pipe 14 and also the junction end 23 of the second pipe 14, at which a continuous weld seam 21 will be placed to join the second pipe 14 to the first pipe 2. The orientation of the exhaust gas comprising the second pipe entry flow 13 is also presented, with the flow continuing through the elbow 17, 18 of the second pipe and exiting at the second tail end 25.

Figure 4B:
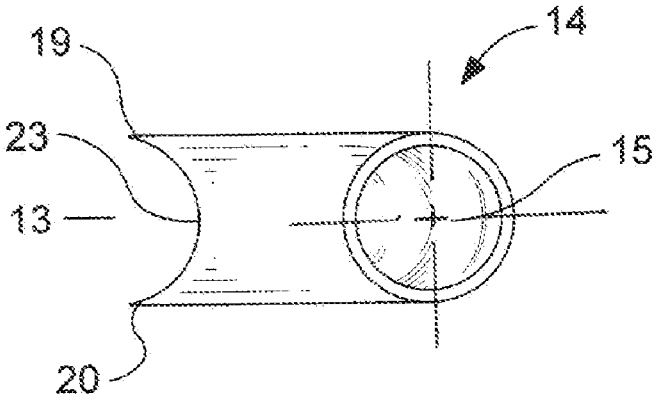
FIG. 4B shows a view of the second pipe, as seen looking coaxially into the second tail end.
Figure 5:
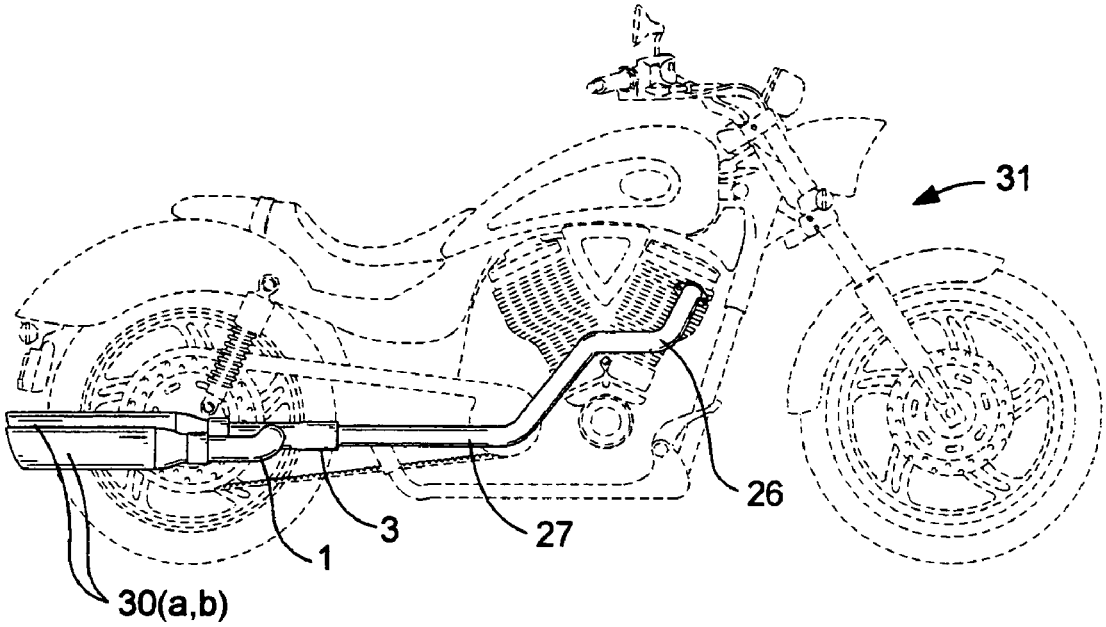
FIG. 5 is a right-side outlined view of a motorcycle outfitted with the exhaust extension unit.

FIG. 4B, in conjunction with FIG. 4A, displays a horizontal view of the second pipe tail end 25, looking along the axis of the second centerline 15 and directly into the cross-sectional area where the exhaust 2 exit flow 24 is emitted. Prior to executing the continuous weld seam 21, the second pipe 14 must be machined at its junction end 23 for the purpose of forming a contoured edge comprising an upper elliptical lip 19 and a lower elliptical lip 20. The said elliptical lips will thereby accurately abut the rounded outer surface of the first pipe 2 precisely over the circular incision 8. It is at this junction end 23 where the exhaust gas separated by the diverter tab 11 comprises the second pipe entry flow 13. The header end 4, first tail end 5, junction end 23, and second tail end 25 of the pipes are then moderately smoothed with a hand grinder and a metal sander to facilitate laminar exhaust flow, a tight-fitting seam weld, and a smooth-to-the touch finish.

To fabricate the finished exhaust extension unit 1, the junction end 23 is held securely against the circular incision 8 of the first pipe 2. A weld is then executed to form a continuous weld seam 21, as shown in FIG. 1, thus bonding the two pipes together. Afterwards, the exhaust extension unit 1 is subjected to an electro-chemical process whereby electro-plating provides a chrome-plated finish to the exterior of the exhaust extension unit 1.

What is claimed is:

1. A device for improving engine efficiency and enhancing the appearance of a motorcycle by means of converting at least one pipe of the existing exhaust system of the motorcycle into a multiple pipe exhaust system, said device comprising a first length of metal pipe having a header end and a trailing end and further having a circular incision forming a deflector tab and further, having a diameter to accommodate the leading or header end of a second length of metal pipe by means of a weld, thereby forming an integral unit comprising two distinct internal routes for the flow of engine exhaust entering the header end of said first pipe and thereafter exiting, in equal volumetric flow, the ends of both pipes.

2. A device for enhancing the appearance and performance efficiency of a multi-cylinder motorcycle engine having one exhaust pipe by means of converting the single exhaust pipe into a dual pipe exhaust system, comprising a) a first pipe having a header end and a tail end;

b) a second pipe, shorter than said first pipe having a junction end and a tail end; and c) a clamp; wherein a circular, partial incision is cut into the wall of said first pipe proximate the entry end of said first pipe;

material remaining attached proximate the point of the partial incision is bent inward at approximately a 45 degree angle relative to the centerline of said first pipe, thereby forming a deflector tab;

said second pipe is bent, under high temperature, into an elliptically-shaped elbow, proximate its junction end;

the junction end of said second pipe is cut and shaped into an elliptical form compatible with the outer curvature of said first pipe;

the junction end of said second pipe is welded onto the circular incision of said first pipe such that the respective centerlines of both said lengths of pipe are oriented in the same horizontal plane, thereby forming an integral exhaust extension unit; and the header end of said first pipe is thereafter attached, by means of said clamp, onto the exhaust pipe or exhaust header extending from the engine of said motorcycle engine.

3. A device, as in claim 2, wherein the junction end of said second pipe is welded onto the circular incision of said first pipe such that the respective centerlines of both said pipes are oriented in the same vertical plane, thereby forming an integral exhaust extension unit.

4. A device for enhancing the appearance and performance efficiency of a motorcycle engine having two exhaust pipes by means of converting the dual pipe exhaust system into a quadruple pipe exhaust system, said device comprising a) a first pipe having a header end and a tail end;

b) a second pipe, shorter than said first pipe having a junction end and a tail end; and c) a means of attaching the header end of the first pipe to the exhaust header or exhaust pipe extending from the motorcycle engine; wherein a circular, partial incision is cut into a wall of said first pipe proximate the header end of said first pipe;

material remaining attached proximate the point of the partial incision is bent inward at approximately a 45 degree angle relative to the centerline of said first pipe thereby forming a deflector tab;

said second pipe is bent, under high temperature, into an elliptically-shaped elbow, proximate its junction end;

the junction end of said second pipe is cut and shaped into an elliptical form compatible with the curvature of the outer wall of said first pipe;

the junction end of said second pipe is welded onto the circular incision of said first pipe; and one each of said exhaust extension units is attached, at the header end of said first pipe, onto the exhaust end of each respective exhaust pipe leading from the engine of said motorcycle.

5. A method for enhancing the appearance and performance efficiency of a motorcycle engine having two exhaust pipes, one on each side of the motorcycle, by means of converting the dual exhaust pipes into a quadruple pipe exhaust system, wherein each of the dual exhaust pipes is augmented by an exhaust extension unit, the quadruple pipe exhaust system being fabricated by a process comprising the steps of:

a) constructing a first pipe, having a header end and a tail end;

b) constructing a second pipe, shorter than first pipe, said second pine having a junction end and a tail end;

c) providing a clamp;

d) cutting a circular, partial incision into the wall of said first pipe proximate the header end of said first pipe;

e) bending inward, the material remaining attached proximate the point of the partial incision, at approximately a 45 degree angle relative to the centerline of said first pipe, thereby forming a deflector tab;

f) bending said second pipe, under high temperature, into an elliptically-shaped elbow, proximate its junction end;

g) cutting and shaping the junction end of said second pine into elliptical compatible with the outer curvature of said first pipe;

h) welding the junction end of said second pipe onto the circular incision of said first pipe such that the respective centerlines of both said lengths of pipe are oriented in the same horizontal plane, thereby forming an integral exhaust extension unit;

i) attaching the header end of said first exhaust extension unit, by means of said clamp, onto the first exhaust pipe or exhaust header extending from the engine of said motorcycle engine;

j) repeating steps a) through i), above, and k) at china the header end of the second exhaust extension unit, by means of said clamp, onto the remaining exhaust pipe or exhaust header extending from the engine said motorcycle engine.

6. A method for enhancing the appearance and performance efficiency of a motorcycle engine having one exhaust pipe, by means of expanding the existing exhaust system into a dual pipe exhaust system wherein the one exhaust pipe is augmented by an exhaust extension unit, whereby said dual pipe exhaust system is fabricated by a process comprising the steps of a) constructing a first pipe having a header end and a tail end;

b) constructing a second pipe, shorter than said first pipe, said second pipe having a junction end and a tail end;

c) providing a clamp;

d) cutting a circular, partial incision into the wall of said first pine proximate the header end of said first pipe;

e) bending inward, the material remaining attached proximate the point of partial incision, at approximately a 45 degree angle relative to centerline of said first pipe, thereby forming a deflector tab;

f) bending said second pipe, under high temperature, into an elliptically-shaped elbow, proximate its junction end;

g) cutting and shaping the junction end of said second pipe into an elliptical form compatible with the outer curvature of said first pipe;

h) welding the junction end of said second nine onto the circular incision of said first pipe such that the respective centerlines of both said lengths of pipe are oriented in the same horizontal plane, thereby forming an integral exhaust extension unit; and i) attaching the header end of said exhaust extension unit, by means of said clamp, onto the one exhaust pipe or exhaust header extending from the engine of said motorcycle engine.

7. A method for enhancing the appearance and performance efficiency of a motorcycle of the model Harley Davidson "Fat Boy," or other motorcycle, having two exhaust pipes, one on each side of said motorcycle, by means of expanding the exhaust system into a quadruple pipe exhaust system, wherein each of the two exhaust pipes is augmented by an exhaust extension unit, the quadruple pipe exhaust system being fabricated by a process comprising the steps of a) constructing a first pipe having a header end and a tail end;

b) constructing a second pipe, shorter than said first pipe, said second pipe having a junction end and a tail end;

c) providing a clamp;

d) cutting a circular, partial incision into the wall of said first pipe proximate the head ender said first pipe;

e) bending inward, the material remaining attached proximate the point of the partial incision, at approximately a 45 angle relative to the centerline of said first pipe, thereby forming a deflector tab;

f) bending said second pipe, under high temperature, into an elliptically-shaped elbow, proximate its junction end;

g) cutting and shaping the junction end of said second pipe into an elliptical form compatible with the outer curvature of said first pipe;

h) welding the junction end of said second pipe onto the circular incision of said first pipe such that the respective centerlines of both said lengths of pine are orient in the same horizontal plane, thereby forming an integral exhaust extension unit; and i) attaching the header end of said first exhaust extension unit, by means of said clamp, onto the first exhaust nine or exhaust header extending from the engine of said motorcycle engine;

j) repeating steps a) through i) above; and k) attaching the header end of the second exhaust extension unit, by means of said clamp, onto the remaining exhaust pipe or exhaust header extending from the engine of said motorcycle engine.

* * * * *